US006568006B1

(12) United States Patent
Hyland

(10) Patent No.: US 6,568,006 B1
(45) Date of Patent: May 27, 2003

(54) HEATED AIR MATTRESS

(76) Inventor: Jayne M. Hyland, 709 Del Mar, El Paso, TX (US) 79932

( * ) Notice: Subject to any disclaimer, the term of this patent is extended or adjusted under 35 U.S.C. 154(b) by 0 days.

(21) Appl. No.: 09/797,665

(22) Filed: Mar. 5, 2001

(51) Int. Cl.[7] ..... A47C 21/04
(52) U.S. Cl. ..... 5/421; 5/284; 5/706
(58) Field of Search ..... 5/284, 421, 706, 5/725, 422; 607/104, 112

(56) References Cited

U.S. PATENT DOCUMENTS

| | | | | | |
|---|---|---|---|---|---|
| 800,967 | A | * | 10/1905 | Young et al. | 5/422 |
| 3,772,717 | A | * | 11/1973 | Yuen et al. | 5/422 |
| 4,108,146 | A | | 8/1978 | Golden | |
| 4,149,541 | A | | 4/1979 | Gammons et al. | |
| D295,349 | S | | 4/1988 | Mueller | |
| 4,884,304 | A | * | 12/1989 | Elkins | 5/421 |
| 4,996,970 | A | * | 3/1991 | Legare | 126/205 |
| 5,074,286 | A | | 12/1991 | Gillaspie et al. | |
| 5,165,127 | A | * | 11/1992 | Nicholson | 5/421 |
| 5,448,788 | A | * | 9/1995 | Wu | 5/421 |
| 5,500,007 | A | * | 3/1996 | Kim et al. | 5/421 |
| 5,514,078 | A | | 5/1996 | Palmer | |
| 5,528,779 | A | * | 6/1996 | Lee et al. | 5/413 AM |
| 5,643,336 | A | | 7/1997 | Lopez-Claros | |
| 5,881,410 | A | * | 3/1999 | Yamada | 5/713 |
| 5,894,615 | A | * | 4/1999 | Alexander | 5/421 |

* cited by examiner

*Primary Examiner*—Michael F. Trettel

(57) ABSTRACT

A heated air mattress for providing a warm and soft air mattress. The heated air mattress includes an air mattress having a top wall, a bottom wall, a back wall, a front wall, a first side wall and a second side wall. Each of the walls of the air mattress is substantially flexible. An air valve for filling the air mattress with air is coupled to the top wall and extends into an interior of the air mattress. A tube for carrying water into the air mattress is elongated and has a first end and a second end. The tube is positioned in the air mattress. Each of the first and second ends of the tube extends outwardly through the front wall of the air mattress. The portion of the tube within the air mattress is securely attached to an inner surface of the top wall. Each of the first and second ends of the tube is fluidly coupled to a water heating and pumping device. The water heating and pumping device is adapted for heating water positioned in the tube and circulating the water through the tube to heat the air mattress.

10 Claims, 6 Drawing Sheets

HEATED AIR MATTRESS

BACKGROUND OF THE INVENTION

1. Field of the Invention

The present invention relates to air mattresses and more particularly pertains to a new heated air mattress for providing a warm and soft air mattress.

2. Description of the Prior Art

The use of air mattresses is known in the prior art. More specifically, air mattresses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,514,078; U.S. Pat. No. 5,643,336; U.S. Pat. No. 4,149,541; U.S. Pat. No. 4,108,146; U.S. Pat. No. 5,074,286; and U.S. Des. Pat. No. 295,349.

While these devices fulfill their respective, particular objectives and requirements, the aforementioned patents do not disclose a new heated air mattress. The inventive device includes an air mattress having a top wall, a bottom wall, a back wall, a front wall, a first side wall and a second side wall. Each of the walls of the air mattress is substantially flexible. An air valve for filling the air mattress with air is coupled to the top wall and extends into an interior of the air mattress. A tube for carrying water into the air mattress is elongated and has a first end and a second end. The tube is positioned in the air mattress. Each of the first and second ends of the tube extends outwardly through the front wall of the air mattress. The portion of the tube within the air mattress is securely attached to an inner surface of the top wall. Each of the first and second ends of the tube is fluidly coupled to a water heating and pumping device. The water heating and pumping device is adapted for heating water positioned in the tube and circulating the water through the tube to heat the air mattress.

In these respects, the heated air mattress according to the present invention substantially departs from the conventional concepts and designs of the prior art, and in so doing provides an apparatus primarily developed for the purpose of providing a warm and soft air mattress.

SUMMARY OF THE INVENTION

In view of the foregoing disadvantages inherent in the known types of air mattresses now present in the prior art, the present invention provides a new heated air mattress construction wherein the same can be utilized for providing a warm and soft air mattress.

The general purpose of the present invention, which will be described subsequently in greater detail, is to provide a new heated air mattress apparatus and method which has many of the advantages of the air mattresses mentioned heretofore and many novel features that result in a new heated air mattress which is not anticipated, rendered obvious, suggested, or even implied by any of the prior art air mattresses, either alone or in any combination thereof.

To attain this, the present invention generally comprises an air mattress having a top wall, a bottom wall, a back wall, a front wall, a first side wall and a second side wall. Each of the walls of the air mattress is substantially flexible. An air valve for filling the air mattress with air is coupled to the top wall and extends into an interior of the air mattress. A tube for carrying water into the air mattress is elongated and has a first end and a second end. The tube is positioned in the air mattress. Each of the first and second ends of the tube extends outwardly through the front wall of the air mattress. The portion of the tube within the air mattress is securely attached to an inner surface of the top wall. Each of the first and second ends of the tube is fluidly coupled to a water heating and pumping device. The water heating and pumping device is adapted for heating water positioned in the tube and circulating the water through the tube to heat the air mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heated air mattress apparatus and method which has many of the advantages of the air mattresses mentioned heretofore and many novel features that result in a new heated air mattress which is not anticipated, rendered obvious, suggested, or even implied by any of the prior art air mattresses, either alone or in any combination thereof.

It is another object of the present invention to provide a new heated air mattress which may be easily and efficiently manufactured and marketed.

It is a further object of the present invention to provide a new heated air mattress which is of a durable and reliable construction.

An even further object of the present invention is to provide a new heated air mattress which is susceptible of a low cost of manufacture with regard to both materials and labor, and which accordingly is then susceptible of low prices of sale to the consuming public, thereby making such heated air mattress economically available to the buying public.

Still yet another object of the present invention is to provide a new heated air mattress which provides in the apparatuses and methods of the prior art some of the advantages thereof, while simultaneously overcoming some of the disadvantages normally associated therewith.

Still another object of the present invention is to provide a new heated air mattress for providing a warm and soft air mattress.

Yet another object of the present invention is to provide a new heated air mattress which includes an air mattress having a top wall, a bottom wall, a back wall, a front wall, a first side wall and a second side wall. Each of the walls of the air mattress is substantially flexible. An air valve for filling the air mattress with air is coupled to the top wall and extends into an interior of the air mattress. A tube for carrying water into the air mattress is elongated and has a first end and a second end. The tube is positioned in the air mattress. Each of the first and second ends of the tube extends outwardly through the front wall of the air mattress. The portion of the tube within the air mattress is securely attached to an inner surface of the top wall. Each of the first and second ends of the tube is fluidly coupled to a water heating and pumping device. The water heating and pumping device is adapted for heating water positioned in the tube and circulating the water through the tube to heat the air mattress.

Still yet another object of the present invention is to provide a new heated air mattress that allows the use of a mattress that warms a person laying thereon and contorts to their body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
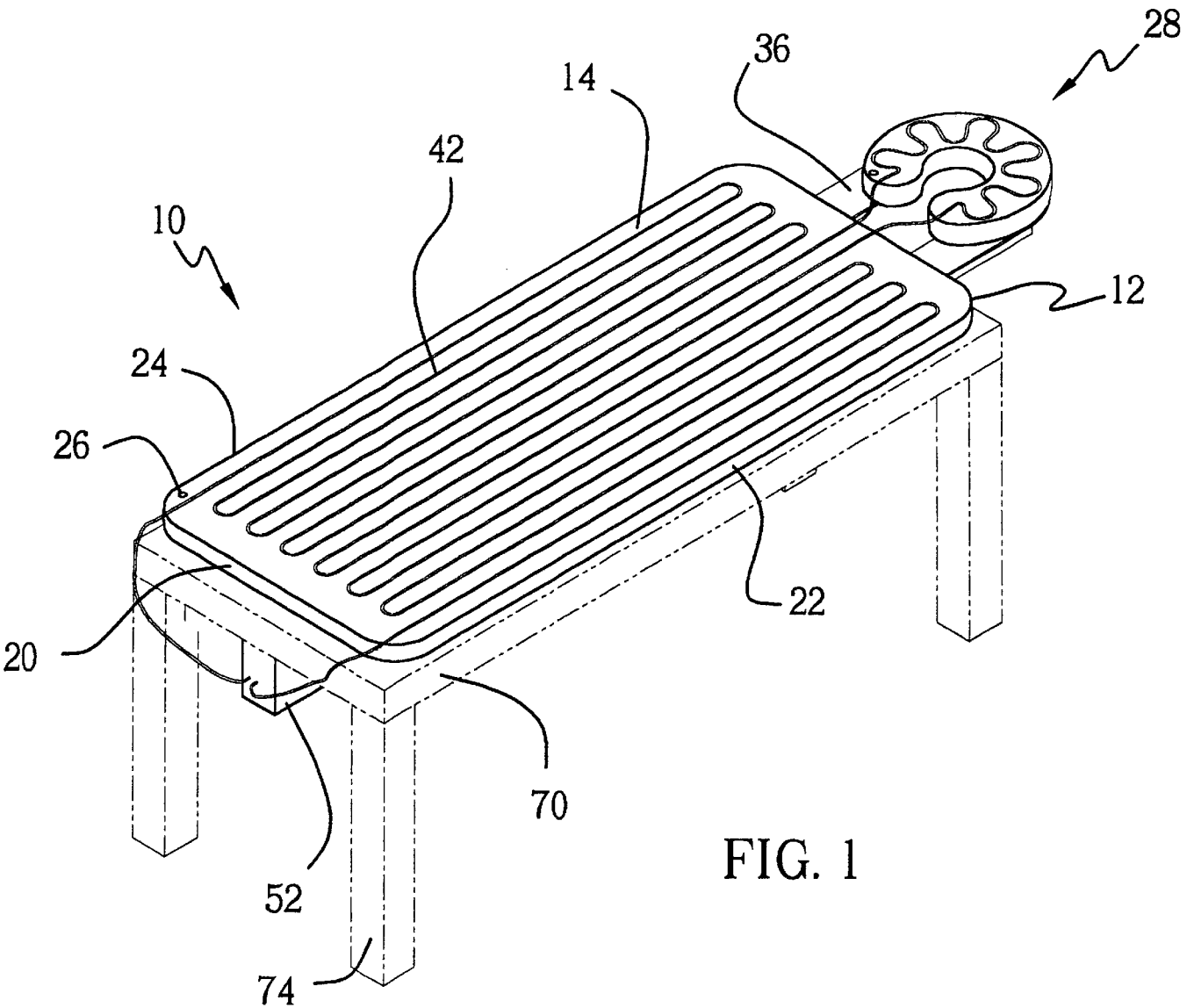
FIG. 1 is a schematic perspective view of a new heated air mattress according to the present invention.

With reference now to the drawings, and in particular to FIGS. 1 through 6 thereof, a new heated air mattress embodying the principles and concepts of the present invention and generally designated by the reference numeral 10 will be described.

As best illustrated in FIGS. 1 through 6, the heated air mattress 10 generally comprises a device for positioning on a conventional massage table 70. The massage table 70 has a platform 72 and a plurality of legs 74. The platform 72 has a back edge 76 having a pair of wells 78 extending therein.

The device 10 includes an air mattress 12 having a top wall 14, a bottom wall 16, a back wall 18, a front wall 20, a first side wall 22 and a second side wall 24. Each of the walls of the air mattress 12 is substantially flexible. An air valve 26 for filling the air mattress 12 with air is coupled to the top wall 14 and extends into an interior of the air mattress 12. It should be understood, the air mattress may also include water filled mattresses, or mattresses which have a resiliently flexible material such as a foamed elastomeric material in place of the air. A distance between the first 22 and second 24 side walls is substantially equal to 30 inches. A distance between the back 18 and front 20 walls is substantially equal to 72 inches. These measurements are conventional measurements of a massage table and may vary within 12 inches for both measurements. A height of the air mattress 12 is generally between ¾ inch and 1 inch when the air mattress is filled with air to a pressure greater than one atmosphere. The height is generally less than 1 inch so that the edges of the device to not cover the edges of the person who is being massages, and thus hindering the massage.

A pillow portion 28, or headrest, has an upper wall 30, a lower wall 32, and a peripheral wall 34 extending between and integrally coupled to the upper 30 and lower 32 walls. Each of the walls of the pillow portion 28 is substantially flexible. An air valve 26 for filling the pillow portion 28 with air is coupled to the upper wall 30 and extends into an interior of the pillow portion 28. As with the mattress, the headrest may be filled with a foamed elastomeric material or water. The pillow portion 28 has a generally U-shaped, or C-shaped, cross-section taken along a plane extending through the peripheral wall 34 and is orientated generally parallel to the upper 30 and lower 32 walls.

A coupler for removably coupling the pillow portion to the massage table includes a plate 36. The plate 36 generally has a shape substantially identical to the lower wall 32 and is securely coupled to the lower wall 32. Each of a pair of rods 40 is securely coupled to the plate 36. Each of the rods 40 extends in a generally parallel direction. The rods are of a standard size which may be extended into conventional wells 78 of a massage table 70.

Figure 2:
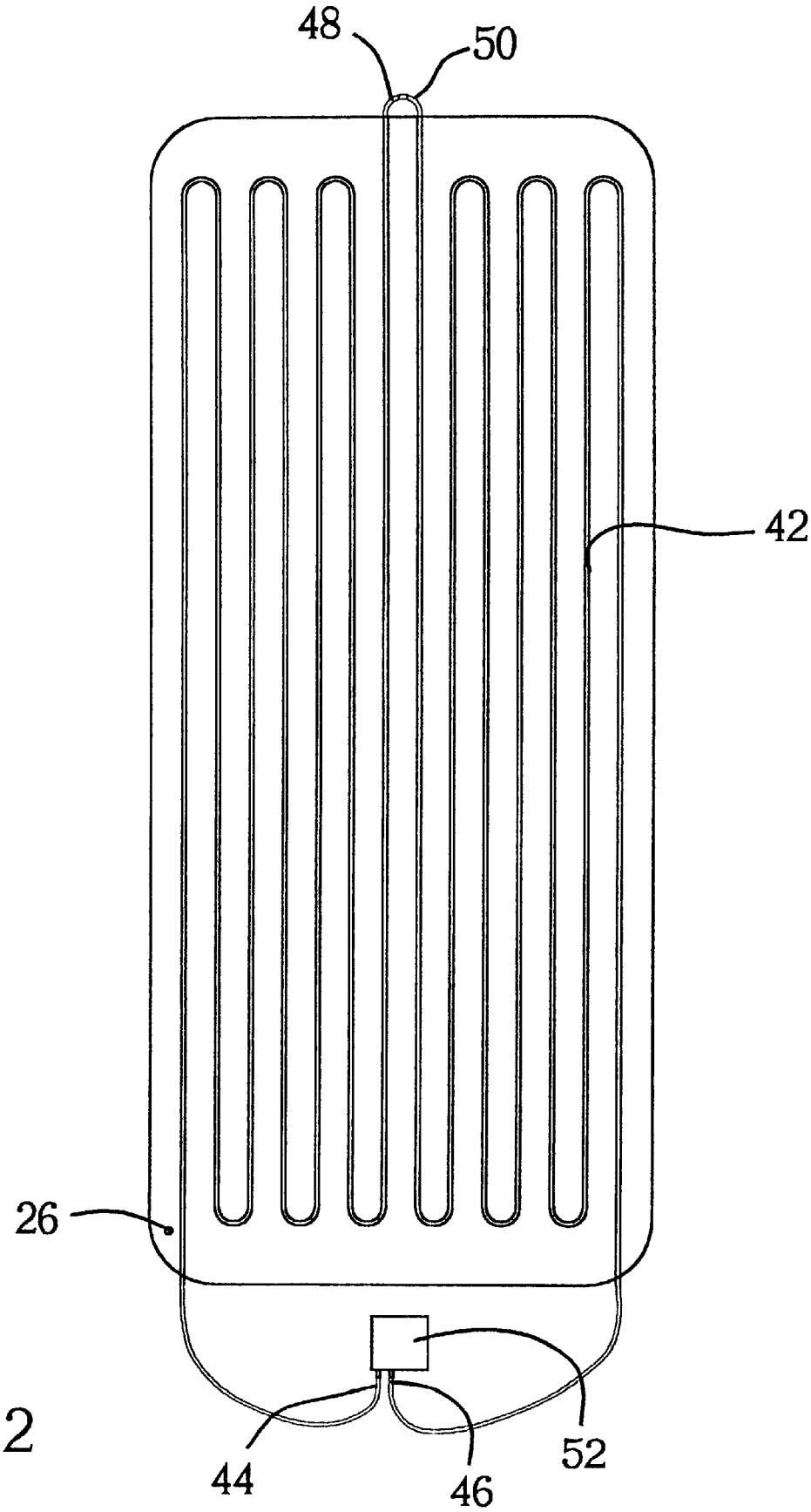
FIG. 2 is a schematic plan view of the present invention.

A tube 42 for carrying water into the air mattress is elongated and has a first end 44 and a second end 46. The tube 42 is positioned in the air mattress 12. Each of the first 44 and second 46 ends of the tube 42 extends outwardly through the front wall 20 of the air mattress 12. The portion of the tube 42 within the air mattress is securely attached to an inner surface of the top wall 14. The portion of the tube within the air mattress ideally weaves about the top wall as shown in FIG. 2. The portion of the tube within the air mattress has a break therein such that a third end 48 and a fourth end 50 of the tube 42 is defined. Each of the third 48 and fourth 50 ends extends outwardly through the back wall 18 of the air mattress. The third 48 and fourth 50 ends may be fluidly coupled together.

Each of the first 44 and second 46 ends of the tube 42 is fluidly coupled to a water heating and pumping device 52. The water heating and pumping device 52 is adapted for heating water positioned in the tube and circulating the water in the tube 42. The water heating and pumping device 52 is conventional and is preferably coupled to the massage table 70.

Figure 3:
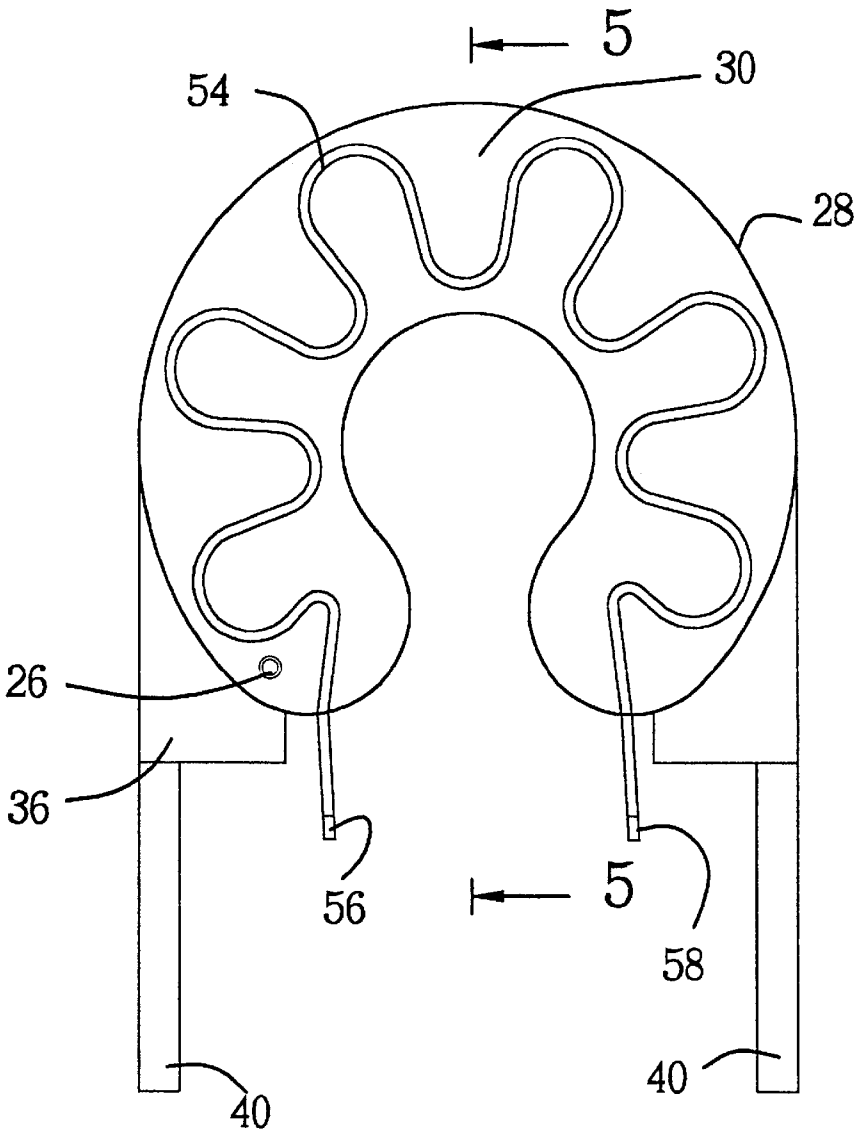
FIG. 3 is a schematic plan view of the pillow portion of the present invention.
Figure 4:
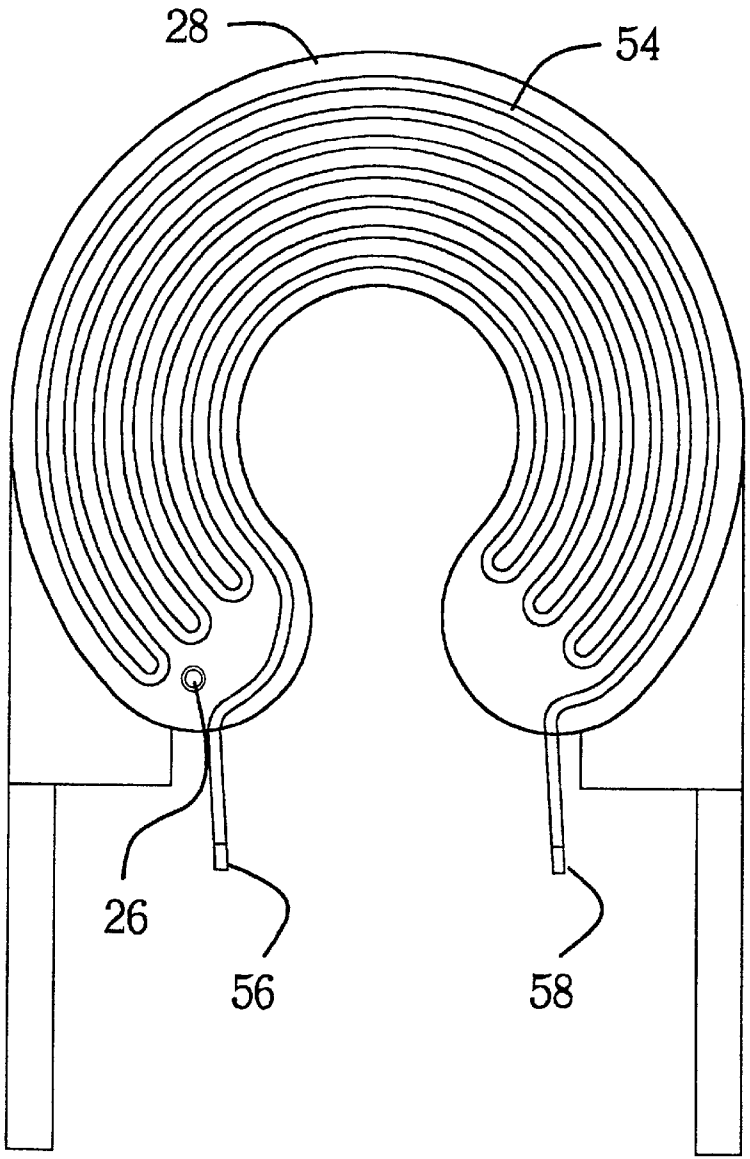
FIG. 4 is a schematic plan view of a second embodiment of the pillow portion of the present invention.
Figure 5:
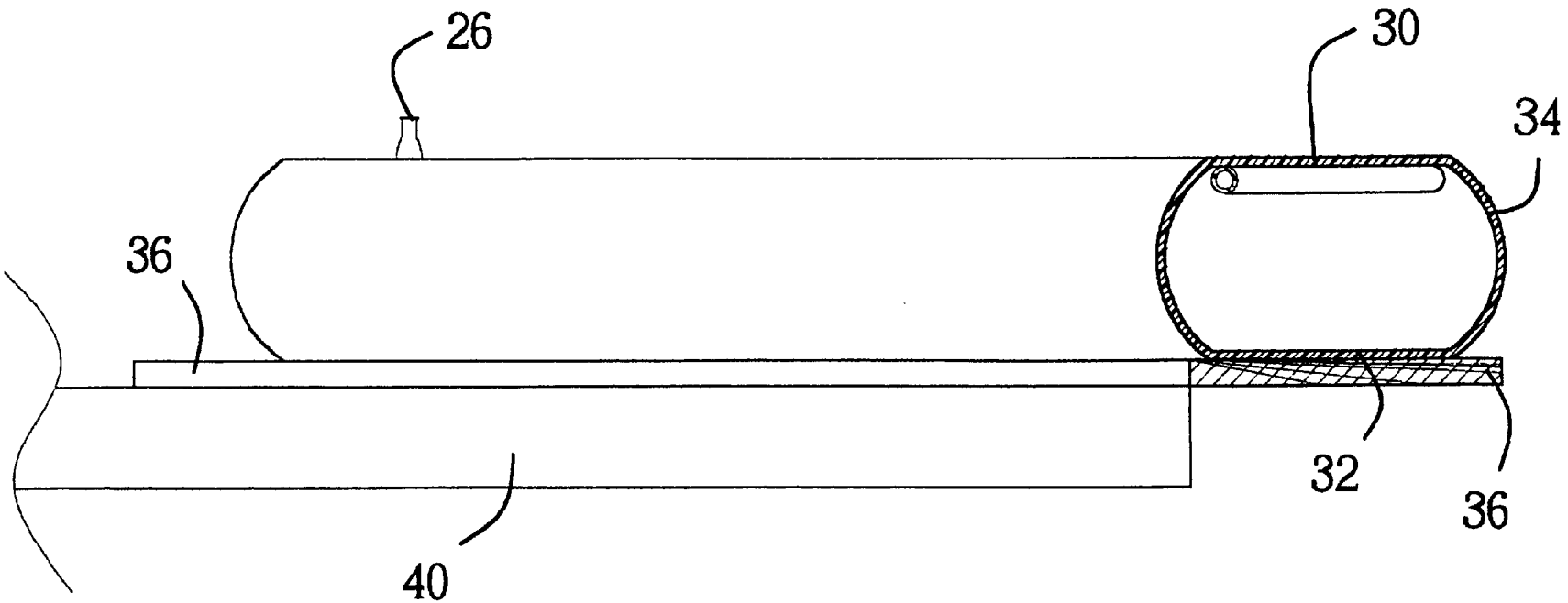
FIG. 5 is a schematic cross-sectional view taken along line 5—5 of the present invention.
Figure 6:
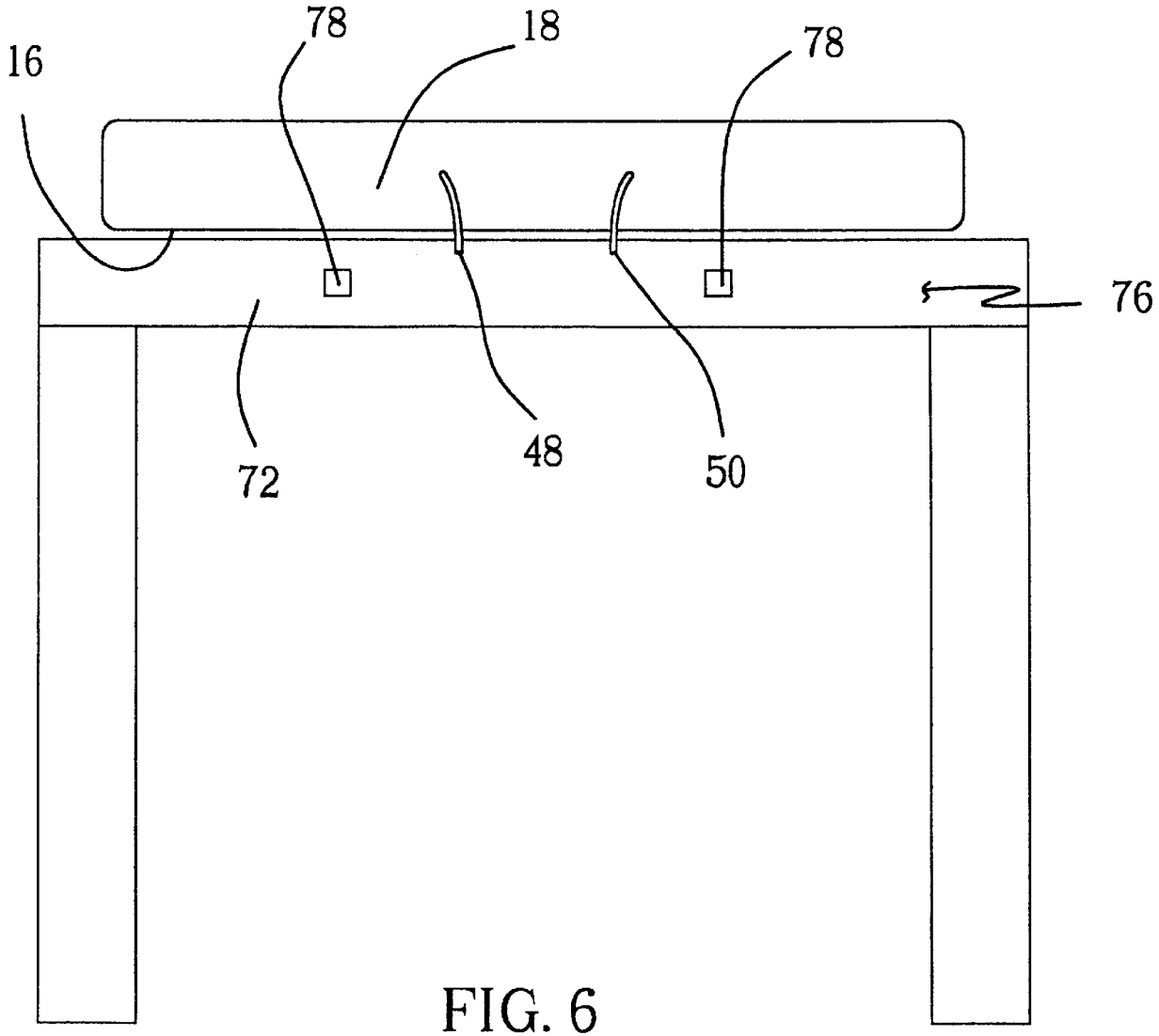
FIG. 6 is a schematic end view of the present invention.

A conduit 54 for carrying water into the pillow portion 28 is elongated and has a first end 56 and a second end 58. The conduit 54 is positioned in the pillow portion 28. Each of the first 56 and second 58 ends of the conduit 54 extends outwardly through the peripheral wall 34 of the pillow portion 28. The portion of the conduit 54 in the pillow portion 28 is securely attached to an inner surface of the upper wall 30. Each of the first 56 and second 58 ends of the conduit may be fluidly coupled to one of the third 48 and fourth 50 ends of the tube 42. The areas where the tube 42 extends through the air mattress and the conduit 54 extends through the pillow portion are airtight so that the mattress and pillow do not lose their air. FIGS. 3 and 4 depict different orientations of the conduit 54.

In use, the device 10 is positioned on a massage table 70 as shown in FIG. 1. The water heating and pumping device 52 is turned on so that water positioned in the tube 42 circulates about the air mattress 12 and pillow portion 28 to warm each of them for the comfort of the person on the massage table 70. The device 10 may be used without the massage table 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated air mattress device for positioning on a massage table, the massage table having a platform and a plurality of legs, said platform having a back edge having a pair of wells extending therein, said device comprising:

an air mattress having a top wall, a bottom wall, a back wall, a front wall, a first side wall and a second side wall, each of said walls of said air mattress being substantially flexible, an air valve for filling said air mattress with air being coupled to said top wall and being in communication with an interior of said air mattress;

a tube for carrying water into said air mattress, said tube being elongated and having a first end and a second end, said tube being positioned in said air mattress, each of said first and second ends of said tube extending outwardly through said front wall of said air mattress, the portion of said tube within said air mattress being securely attached to an inner surface of said top wall;

a water heating and pumping device, each of said first and second ends of said tube being fluidly coupled to said water heating and pumping device, wherein said water heating and pumping device is adapted for heating water positioned in said tube and circulating said water in said tube;

a pillow portion having an upper wall, a lower wall, and a peripheral wall extending between and being integrally coupled to said upper and lower walls, each of said walls of said pillow portion being substantially flexible, an air valve for filling said pillow portion with air being coupled to said upper wall and extending into an interior of said pillow portion;

said portion of said tube within said air mattress having a break therein such that a third end and a fourth end of said tube are defined, each of said third and fourth ends extending outwardly through said back wall of said air mattress, wherein said third and fourth ends may be fluidly coupled together; and a conduit for carrying water into said pillow portion, said conduit being elongated and having a first end and a second end, said conduit being positioned in said pillow portion, each of said first and second ends of said conduit extending outwardly through said peripheral wall of said pillow portion, the portion of said conduit in said pillow portion being securely attached to an inner surface of said upper wall, wherein each of said first and second ends of said conduit may be fluidly coupled to one of said third and fourth ends of said tube.

2. The heated air mattress device as in claim 1, wherein a distance between said first and second side walls being substantially equal to 30 inches, a distance between said back and front walls being substantially equal to 72 inches, a height of said air mattress being generally between ¾ inch and 1 inch when said air mattress is filled with air to a pressure greater than one atmosphere.

3. The heated air mattress device as in claim 1, a height of said air mattress is generally between ¾ inch and 1 inch when said air mattress is filled with air to a pressure greater than one atmosphere.

4. The heated air mattress device as in claim 1, wherein said pillow portion has a generally U-shaped cross-section taken along a plane extending through said peripheral wall and being orientated generally parallel to said upper and lower walls.

5. The heated air mattress device as in claim 1, further including:

a coupler for removably coupling said pillow portion to said massage table, said coupler including a plate, said plate being securely coupled to said lower wall, each of a pair of rods being securely coupled to said plate, each of said rods extending in a generally parallel direction, each of said rods being extendably positionable in one of said wells in said massage table.

6. A heated mattress device for positioning on a massage table, the massage table having a platform and a plurality of legs, said platform having a back edge having a pair of wells extending therein, said device comprising:

an mattress having a top wall, a bottom wall, a back wall, a front wall, a first side wall and a second side wall, each of said walls of said mattress being substantially flexible, said mattress having an interior being substantially filled with a resiliently flexible material;

a tube for carrying water into said mattress, said tube being elongated and having a first end and a second end, said tube being positioned in said mattress, each of said first and second ends of said tube extending outwardly through said front wall of said mattress, the portion of said tube within said mattress being securely attached to an inner surface of said top wall;

a water heating and pumping device, each of said first and second ends of said tube being fluidly coupled to said water heating and pumping device, wherein said water heating and pumping device is adapted for heating water positioned in said tube and circulating said water in said tube;

a pillow portion having an upper wall, a lower wall, and a peripheral wall extending between and being integrally coupled to said upper and lower walls, each of said walls of said pillow portion being substantially flexible, an interior of said pillow portion being substantially filled with a resiliently flexible material;

said portion of said tube within said mattress having a break therein such that a third end and a fourth end of said tube are defined, each of said third and fourth ends extending outwardly through said back wall of said mattress, wherein said third and fourth ends may be fluidly coupled together; and a conduit for carrying water into said pillow portion, said conduit being elongated and having a first end and a second end, said conduit being positioned in said pillow portion, each of said first and second ends of said conduit extending outwardly through said peripheral wall of said pillow portion, the portion of said conduit in said pillow portion being securely attached to an inner surface of said upper wall, wherein each of said first and second ends of said conduit may be fluidly coupled to one of said third and fourth ends of said tube.

7. The heated mattress device as in claim 6, wherein a distance between said first and second side walls being substantially equal to 30 inches, a distance between said back and front walls being substantially equal to 72 inches, a height of said mattress being generally between ¾ inch and 1 inch.

8. The heated mattress device as in claim 6, wherein said pillow portion has a generally U-shaped cross-section taken along a plane extending through said peripheral wall and being orientated generally parallel to said upper and lower walls.

9. The heated mattress device as in claim 6, further including:

a coupler for removably coupling said pillow portion to said massage table, said coupler including a plate, said plate being securely coupled to said lower wall, each of a pair of rods being securely coupled to said plate, each of said rods extending in a generally parallel direction, each of said rods being extendably positionable in one of said wells in said massage table.

10. A heated air mattress device for positioning or a massage table, a said coupler including a platform and a plurality of legs, said platform having a back edge having a pair of wells extending therein, said device comprising:

an air mattress having a top wall, a bottom wall, a back wall, a front wall, a first side wall and a second side wall, each of said walls of said air mattress being substantially flexible, an air valve for filling said air mattress with air being-coupled to said top wall and extending into an interior of said air mattress, a distance between said first and second side walls being substantially equal to 30 inches, a distance between said back and front walls being substantially equal to 72 inches, a height of said air mattress being generally between ¾ inch and 1 inch when said air mattress is filled with air to a pressure greater than one atmosphere;

a pillow portion having an upper wall, a lower wall, and a peripheral wall extending between and being integrally coupled to said upper and lower walls, each of said walls of said pillow portion being substantially flexible, an air valve for filling said pillow portion with air being coupled to said upper wall and extending into an interior of said pillow portion, said pillow portion having a generally U-shaped cross-section taken along a plane extending through said peripheral wall and being orientated generally parallel to said upper and lower walls;

a coupler for removably coupling said pillow portion to said massage table, said coupler including a plate, said plate generally having a shape substantially identical to said lower wall and being securely coupled to said lower wall, each of a pair of rods being securely coupled to said plate, each of said rods extending in a generally parallel direction, each of said rods being extendably positionable in one of said wells in said massage table;

a tube for carrying water into said air mattress, said tube being elongated and having a first end and a second end, said tube being positioned in said air mattress, each of said first and second ends of said tube extending outwardly through said front wall of said air mattress, the portion of said tube within said air mattress being securely attached to an inner surface of said top wall, said portion of said tube within said air mattress weaving about said top wall, said portion of said tube within said air mattress having a break therein such that a third end and a fourth end of said tube are defined, each of said third and fourth ends extending outwardly through said back wall of said air mattress, wherein said third and fourth ends may be fluidly coupled together;

a water heating and pumping device, each of said first and second ends of said tube being fluidly coupled to said water heating and pumping device, wherein said water heating and pumping device is adapted for heating water positioned in said tube and circulating said water in said tube, said water heating and pumping device being removably coupled to the massage table; and a conduit for carrying water into said pillow portion, said conduit being elongated and having a first end and a second end, said conduit being positioned, in said pillow portion, each of said first and second ends of said conduit extending outwardly through said peripheral wall of said pillow portion, the portion of said conduit in said pillow portion being securely attached to an inner surface of said upper wall, wherein each of said first and second ends of said conduit may be fluidly coupled to one of said third and fourth ends of said tube.

* * * * *